United States Patent [19]

Guggenheimer et al.

[11] Patent Number: 4,763,845

[45] Date of Patent: Aug. 16, 1988

[54] MOBILE CRUSHER SYSTEM

[75] Inventors: Kurt Guggenheimer; Hermann Mecklenfeld, both of Ennigerloh, Fed. Rep. of Germany

[73] Assignee: O&K Orenstein & Koppel Aktiengesellschaft, Dortmund, Fed. Rep. of Germany

[21] Appl. No.: 9,185

[22] Filed: Jan. 30, 1987

[30] Foreign Application Priority Data

Mar. 15, 1986 [DE] Fed. Rep. of Germany ..... 3608789

[51] Int. Cl.[4] ..... B02C 21/02

[52] U.S. Cl. ..... 241/101.7; 241/285 B

[58] Field of Search ..... 241/101.7, 285 R, 285 A, 241/202, 285 B, 223, 186.2, 245, 186.3, 135

[56] References Cited

U.S. PATENT DOCUMENTS

| | | | |
|---|---|---|---|
| 3,817,462 | 6/1974 | Hamlin | 241/101.7 |
| 4,177,953 | 12/1979 | Pinto | 241/101.7 X |
| 4,544,104 | 10/1985 | Carlsson | 241/101.7 X |

FOREIGN PATENT DOCUMENTS 1731834 10/1956 Fed. Rep. of Germany .

*Primary Examiner*—Mark Rosenbaum
*Attorney, Agent, or Firm*—Martin A. Farber

[57] ABSTRACT

A mobile crusher installation having a supporting framework which receives at least one crusher and can be lifted and relocated, corresponding to the advance or the removal of material, by a transport mechanism, preferably walking legs or extendable track-laying or wheel carriages, and having at least one loading device associated with at least one crusher, which loading device has a receiving hopper for the loose material brought up by freely movable loading machines such as wheel loading machines or excavators, and a conveyor which feeds the loose material to a transfer hopper of the crusher, possibly with the interpositioning of a screening system. In order to increase the availability of the mobile crusher installation while at the same time retaining the optimum loading capacity of the loading machines, the loading device is mounted on the supporting framework swingable around a vertical axis. Furthermore, the loading device can, in addition, be swingable around a horizontal axis which lies within the region where it dumps its material.

9 Claims, 5 Drawing Sheets

MOBILE CRUSHER SYSTEM

FIELD AND BACKGROUND OF THE INVENTION

The present invention relates to a mobile crusher installation in general.

In particular the invention relates to a mobile crusher system having a supporting framework which receives at least one crusher and which can be lifted and relocated, in accordance with the advance of the removal of material, by a transport mechanism, preferably a walking-leg system or an extendable track-laying or wheel undercarriage, and having at least one charging device which is associated with at least one crusher, and having a receiving hopper for the loose material delivered by freely transporting loading machines such as wheel loaders or excavators, and having a conveyor which feeds the loose material to a transfer hopper of the crusher, possibly with the interposition of a screening system.

Such mobile crusher installations are already known. Their charging devices are rigidly connected to the crusher and thus to the supporting framework, so that as the removal work proceeds either the loading machines must travel over larger distances, as a result of which their loading capacity decreases, or the crusher installation must be relocated more frequently, which means in each case certain standstill times for the crusher.

SUMMARY OF THE INVENTION

It is an object of the invention to improve a mobile crusher installation of the above-described type in such a manner that its availability is increased while simultaneously retaining the optimal loading capacity of the loading machines.

According to the invention, the loading device (8) is mounted on the supporting framework (1), swingable around a vertical axis (13).

By the invention there is created a mobile crusher installation which can remain considerably longer in its immediate position since its loading device can be swung in accordance with the corresponding advance of the removal of material, so that the travel distances of the loading machines are shortened. Despite the increased availability of the crusher installation, optimum loading capacity of the loading machines is thus obtained and thus, as a whole, a considerable increase in the output of the mobile crusher installation at little structural expense is attained.

In accordance with another feature of the invention, the loading device (8) is furthermore swingable around a horizontal axis (16) located in the region of its place of dumping. This additional possibility of swing of the loading device around a horizontal axis permits the relocation and operation of the crusher installation even on rough terrain.

In order to prevent stresses on the articulations upon the relocation of the crusher installation, the loading device (8) can, in accordance with the invention, be fixed in a transport position on the supporting framework (1) by means of a locking device (15).

In one particularly simple structural development of the crusher system of the invention, the loading device (8) is provided with skids or the like for resting on the ground to swing past a loading machine (6). In this way, additional devices and means for the swinging of the loading device are dispensed with.

As an alternative to this, it is possible to provide the supporting framework (1) with sliding or rolling surfaces for the loading device (8), which surfaces are swingable by means of a swinging device, preferably hydraulic cylinders. In this embodiment, the forces to be applied for the swinging of the loading device are taken up by the supporting framework.

In order to substantially relieve the supporting framework from swinging forces for the loading device, it is possible in a preferred embodiment of the invention to provide the loading device (8), in the region of its receiving hopper (7), with its own undercarriage (14), preferably an extendable wheel or caterpillar undercarriage. In this way, the loading device is supported on the ground also during the swinging process, so that the supporting framework is relieved of the swinging forces.

A particularly simple structural embodiment is obtained if, in accordance with the invention, the loading device (8) is swignable around the vertical central axis (13) of the crusher (2).

In order to increase the capacity of the crusher system of the invention it is finally possible to provide the supporting framework (1) with two crushers (2) each of which has a loading device (8) associated with it, the loading devices being swingable relative to each other and to the supporting framework (1) from a starting position extending parallel to each other, in each case through a range of swing covering at least 90°.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
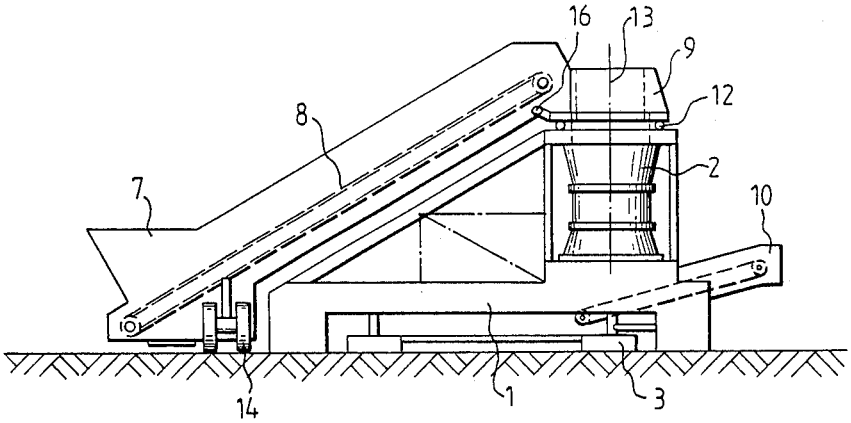
FIG. 1 is a side view of a first embodiment of the invention, shown in operating position.

Each of the embodiments shown has a mobile crusher installation with a supporting framework 1 on which one crusher 2 is arranged in the case of the first three embodiments and two crushers 2 in the case of the fourth embodiment. The supporting framework 1 can be lifted and relocated by a transport mechanism in accordance with the advance of the removal of the material. In the first embodiment, shown in FIGS. 1 to 3, the transport mechanism is formed by walking legs 3. In the second embodiment, shown in FIGS. 4 and 5, an extendable wheel undercarriage 4 is provided for the lifting and relocating of the supporting mechanism 1. The third embodiment, shown in FIGS. 6 and 7, uses as transport mechanism a track-laying undercarriage 5 provided with a vertically adjustable lift table.

Figure 2:
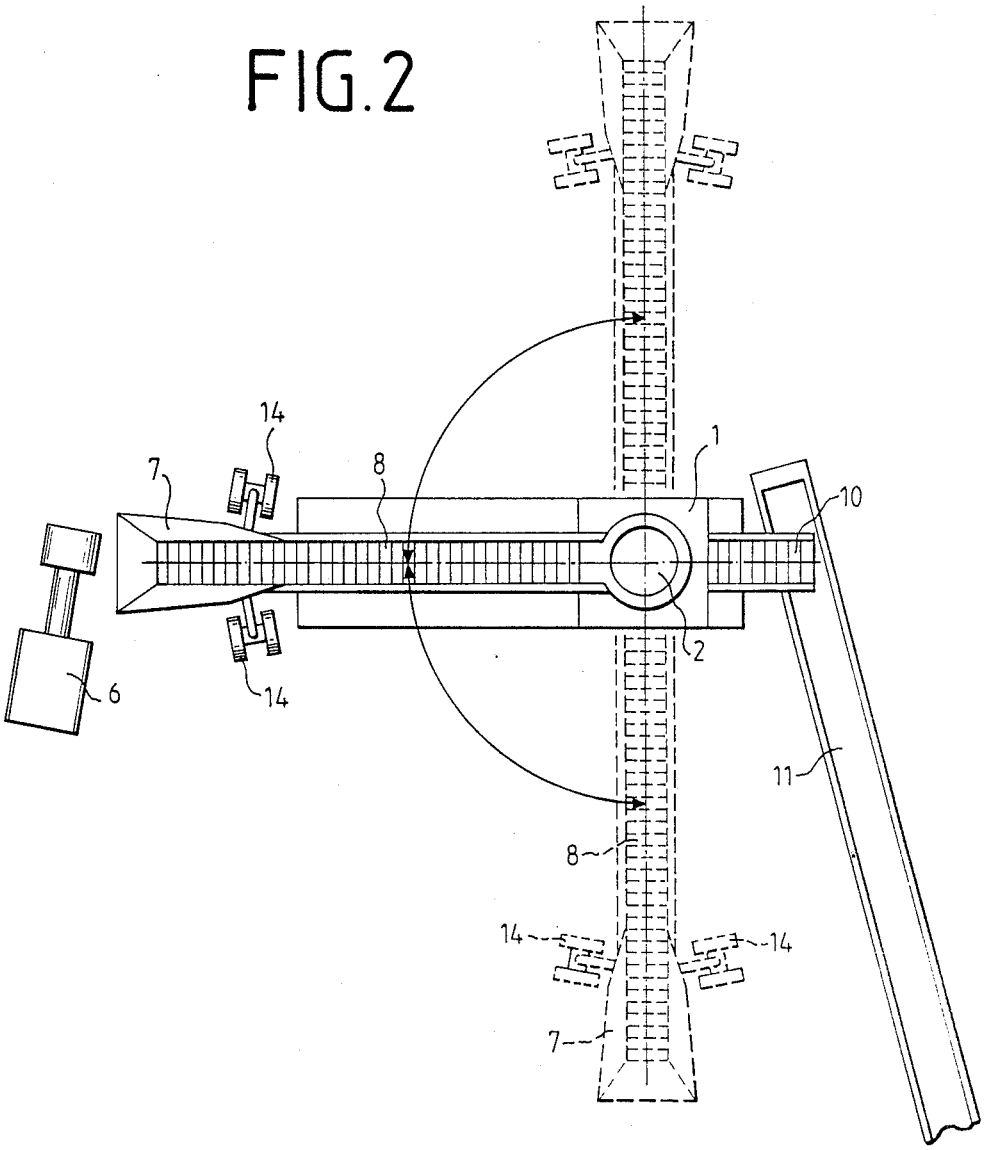
FIG. 2 is a top view of the embodiment of FIG. 1.
Figure 8:
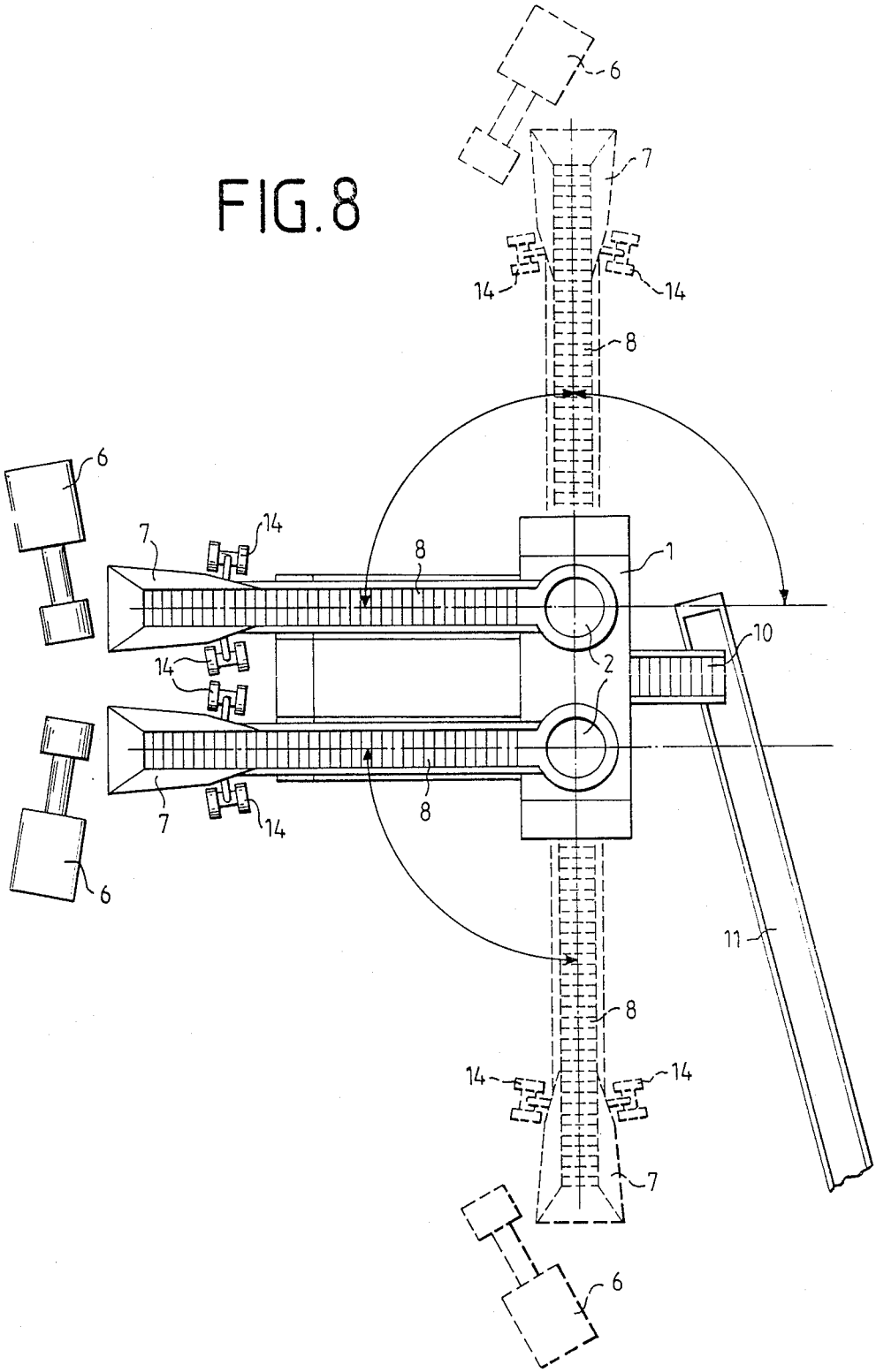
FIG. 8 is a top view of a fourth embodiment.

The loose material to be crushed in the crusher 2 is fed to the mobile crusher installation by means of freely movable loading machines 6, they being preferably wheel loaders or excavators. These loading machines 6 transport the loose material which has been obtained, for instance, in a quarry or in an open-pit ore or coal mine to a receiving hopper 7 of a loading device 8 which, for example, comprises a continuous conveyor in the form of a conveyor or plate belt and charges the loose material into a transfer hopper 9 of the crusher 2. From this transfer hopper 9 the loose material enters into the crusher 2, from which it is removed, for instance, by means of a removal belt 10 and—as shown in FIGS. 2 and 8—fed to a conveyor belt system 11 which conducts it further.

By means of a swivel connection 12 shown in the drawings, in the region of the transfer hopper 9, the loading device 8 is mounted for swinging around a vertical axis 13 on the supporting framework 1. In the embodiments shown, this vertical axis 13 coincides with the vertical central axis of the crusher 2. As a result of this swingable mounting of the loading device 8, it is possible to swing said device, from a central position shown in solid lines in FIGS. 2 and 8, within a predetermined region of swing and bring it, for instance, into the position shown in dashed line. The range of swing can, in accordance with FIG. 2, amount to 180°. In the embodiment shown in FIG. 8, the one loading device 8, namely the one shown at the top, is also swingable 180° out of the initial position, while the range of swing of the other loading device 8 has been assumed to be 90°, as the arrows shown in these two figures indicate.

In order that the weight of the entire loading device 8 does not act on the swivel connection 12, the loading device 8 can be provided with skids or the like for resting on the ground. The swinging can be effected by one of the loading devices 8. As an alternative to this, it is possible to provide the supporting framework 1 with sliding or rolling surfaces for the loading device 8 and to swing the latter by means of a swinging device, preferably hydraulic cylinders.

Figure 6:
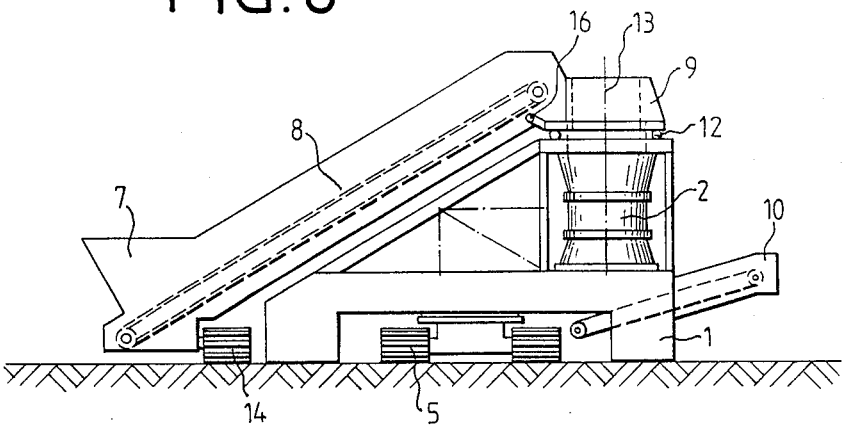
FIG. 6 is a side view of a third embodiment, shown in the operating position.

In the embodiments shown in the drawing, the loading device 8 is provided in each case with its own undercarriage 14 in the region of its receiving hopper 7. This undercarriage 14 is preferably developed as an extendable wheel undercarriage but, as shown in the embodiment of FIGS. 6 and 7, it can also be developed as a track-laying undercarriage.

Figure 3:
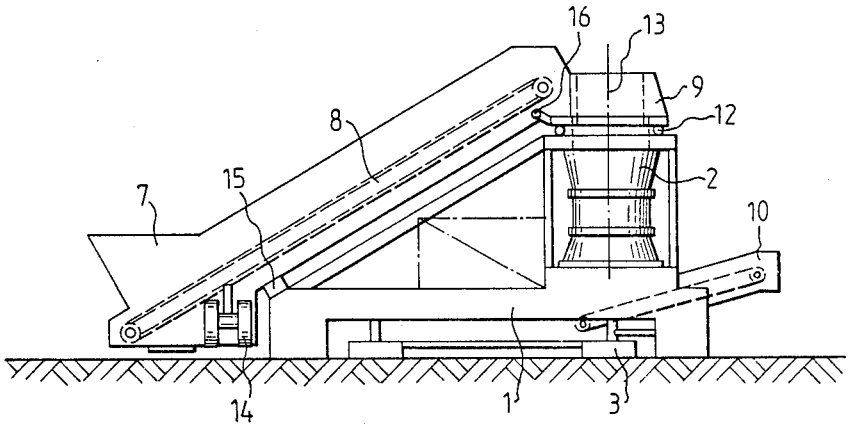
FIG. 3 is a side view of the crusher system of FIG. 1, shown in transport position.
Figure 4:
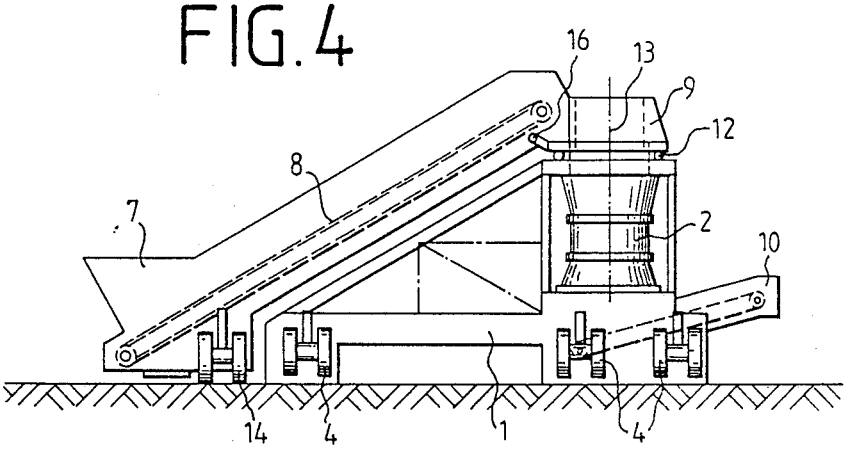
FIG. 4 is a side view, corresponding to FIG. 1, of a second embodiment, shown in operating position.
Figure 5:
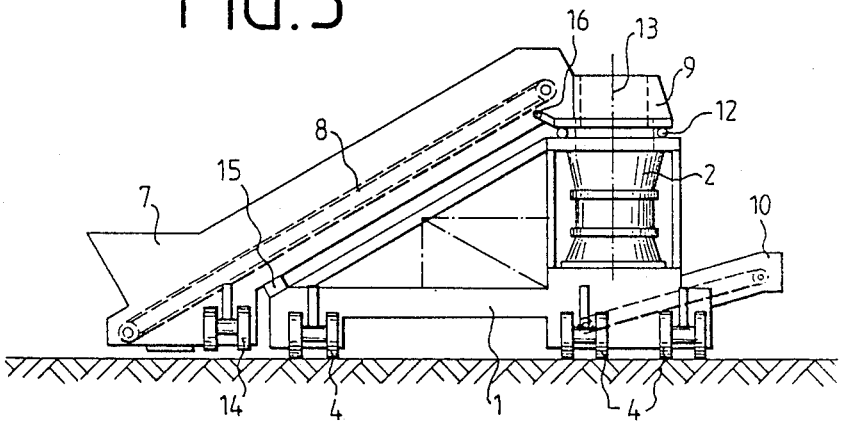
FIG. 5 is a side view, corresponding to FIG. 4, of the second embodiment, shown in the transport position.
Figure 7:
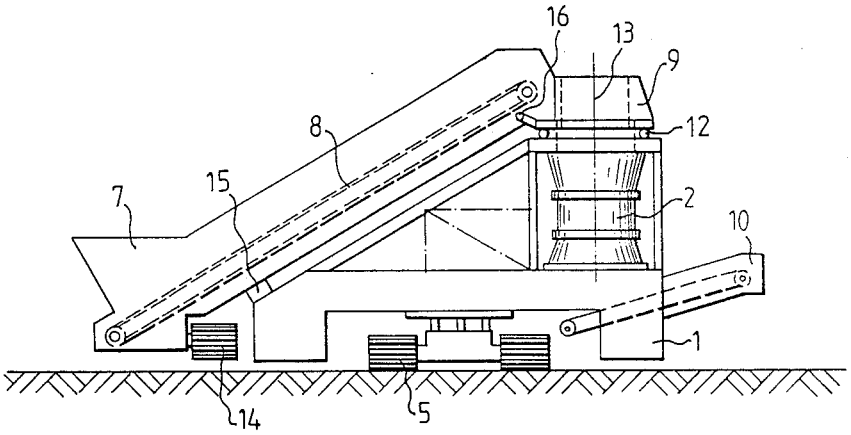
FIG. 7 is a side view corresponding to FIG. 6 shown in the transport position.

In order to avoid undesired stress on the swivel connection 12 upon the relocation of the mobile crusher installation, a locking device 15 is provided by which the loading device 8 is locked in transport position on the supporting framework 1 with the undercarriage 14 retracted, as shown in FIGS. 3, 5 and 7. In these transport positions, the supporting framework is relocated, corresponding to the advance of the removal of the material, by means of its transport mechanism, namely the walking legs 3, wheel undercarriage 4 or track-laying undercarriage 5, after the supporting mechanism 1 together with the crusher 2 and the loading device 8 have been lifted off the ground.

In order to facilitate the relocation and operation of the mobile crusher installation even on uneven terrain, in the embodiments shown the loading device 8 is furthermore swingable around a horizontal axis 16 which lies in the region where it dumps its material. This swivel connection is also relieved from load if the loading device 8 is locked in the transport position on the supporting framework 1 by the locking device 15 when the crusher installation is relocated.

The mobile crusher installation described above can remain at its immediate location considerably longer, since the loading device 8 can be swung in accordance with the progress of the removal of material, so that the travel distances of the loaders 6 are shortened. This results in increased availability of the crusher installation. The loading capacity obtainable with the loading machines 6 is simultaneously increased, so that, as a whole, a considerable increase in capacity of the mobile crusher installation is obtained.

We claim:

1. In a mobile crusher system for use in a stone quarry or in strip ore or coal mining having a supporting framework which holds at least one crusher, which system can be lifted and relocated in accordance with an advance in the removal of material by any one of a class of transport mechanisms, including a walking-leg system, an exendable track-laying system and a wheel undercarriage system; said crusher system further having at least one loading device which is associated with at least one crusher, a receiving hopper for loose material delivered by freely transporting loading machines such as wheel loaders or excavators, and a conveyor which feeds the loose material to the crusher by one of a class of transfer hoppers including a direct feed hopper and a hopper incorporating a screening system; the improvement wherein said crusher system further comprises a vertical pivot, said loading device being rotatably mounted on the supporting framework by said vertical pivot to be swingable around a vertical axis;

a horizontal pivot located in the region of a dishcarge from said loading device, said loading device being mounted further to said framework by said horizontal pivot, and being swingable around a horizontal axis located in the region of discharge;

a locking device, and wherein said loading device can be fixed in a transport position on the supporting framework by means of said locking device;

said vertical pivot includes surface contact means affixed to said supporting framework for supporting said loading device during a swinging of said loading device; and said surface contact means includes a rolling surface.

2. The mobile crusher system according to claim 1, wherein said loading device is provided with skid means for resting on the ground and allowing a swinging of the loading device past a loading machine.

3. The mobile crusher system according to claim 1, further comprising a swinging device for swinging said loading device about said framework.

4. The mobile crusher system according to claim 3, wherein said swinging device comprises hydraulic cylinders.

5. The mobile crusher system according to claim 1, wherein said loading device, in the region of its receiving hopper, is provided with its own undercarriage.

6. The mobile crusher system according to claim 5, wherein said undercarriage is an extendable wheel.

7. The mobile crusher system according to claim 5, wherein said undercarriage is a caterpillar undercarriage.

8. The mobile crusher system according to claim 1, wherein said vertical pivot provides for a swinging of said loading device around the vertical central axis of a crusher of the crusher system.

9. The mobile crusher system according to claim 1, wherein the crusher system includes two crushers pivotally supported by said supporting framework, each of the two crushers having a load device associated therewith, the loading devices being swingable relative to each other and to the supporting framework from a starting position extending parallel to each other, in each case through a range of swing covering at least 90°.

* * * * *